United States Patent [19]

Okumura et al.

[11] Patent Number: 4,541,748

[45] Date of Patent: Sep. 17, 1985

[54] SERIAL PRINTER WITH INK ROLLER

[75] Inventors: Ryuichi Okumura; Hidemi Dohi; Shingo Togawa, all of Tottri, Japan

[73] Assignees: Sanyo Electric Co., Ltd.; Tottori Sanyo Electric Co., Ltd., both of Japan

[21] Appl. No.: 572,842

[22] Filed: Jan. 23, 1984

[30] Foreign Application Priority Data

Jan. 24, 1983 [JP] Japan ..... 58-8859
Feb. 17, 1983 [JP] Japan ..... 58-25915

[51] Int. Cl.[4] ..... B41J 27/12; B41J 1/30

[52] U.S. Cl. ..... 400/470; 400/471; 400/144.2

[58] Field of Search ..... 400/470–471.1, 400/144.2, 153.2, 154.2

[56] References Cited

U.S. PATENT DOCUMENTS 3,306,416 2/1967 Dahlin et al. ..... 400/134.2
4,106,873 8/1978 Drejza et al. ..... 400/470
4,131,840 12/1978 Wiesner ..... 400/154.2

FOREIGN PATENT DOCUMENTS 113584 9/1980 Japan ..... 400/154.3
137179 8/1982 Japan ..... 400/144.2
142384 9/1982 Japan ..... 400/470
159677 10/1982 Japan ..... 400/471
160679 10/1982 Japan ..... 400/470
802092 2/1981 U.S.S.R. ..... 400/471

*Primary Examiner*—William Pieprz
*Attorney, Agent, or Firm*—Darby & Darby

[57] ABSTRACT

A printer which is provided with a daisy wheel so that the types thereof are brought into contact with an ink roller to thereby apply ink onto the types and constructed to be disposed the ink roller at the position at an angle of 90° or less circumferential of the daisy wheel from the printing position.

The position of the types is grouped into two regions defined in connection with the ink roller set position and the rotation direction of the daisy wheel is decided by the region in which the types to be printed are positioned, in order to get high printing speed.

The fingers located at a portion corresponding to the ink roller set position when the daisy wheel is in a printing-stand-by condition are smaller in length than others and have no type respectively, thereby preventing the daisy wheel from being deformation.

20 Claims, 11 Drawing Figures

SERIAL PRINTER WITH INK ROLLER

BACKGROUND OF THE INVENTION

1. Field of the Invention

This invention relates to a printer which carries out printing by applying ink by an ink roller onto the type at a daisy wheel, and more particularly to a printer which controls the daisy wheel in the rotation direction and an amount of rotations by means of a circumferential angle between the type to be printed and the ink roller to thereby devise an improvement in the printing speed, allow the type to be applied further exactly with ink, and enable the daisy wheel to be prevented from deformation.

2. Description of the Prior Art

Conventionally, a printer using the daisy wheel carries out printing by use of an ink ribbon, which method needs a drive mechanism for the ink ribbon and is complicated in construction. Hence, it has been proposed by the Japanese Patent Publication No. 4635 in 1983 that the ink roller unnecessary of the complicated drive mechanism is used to apply ink on the type for printing. In this case, however, there is a problem in that the printing time varies corresponding to the set position of ink roller, whereby it is an important point for the influence on the printing speed of printer what place the ink roller is to be set in. In other words, in a case where an ink roller 1, as shown in FIG. 1, is set in the position apart at a circumferential angle of 180° from the printing position P on a daisy wheel 2 so that the type in proximity to the position P is intended to print, the daisy wheel 1 should be rotated at about 360° to bring the type once to the ink roller set position, and after applied with ink, the type reaches the printing position P, which is not preferable because of a long time taken from a printing command given until the printing is performed. Also, in a case where the ink roller 1, as shown in FIG. 2, is set in the position apart at an angle of 90° on the circumference of daisy wheel 2 from the printing position P, in order to print the type apart at about 180° on the circumference from the daisy wheel 2, the daisy wheel 2 should be rotated at 270° to a maximum. Hence, the above Japanese Patent Publication No. 4635 in 1983 discloses that, as shown in FIG. 3, two ink rollers 1, 1 are set apart at an angle of 90° from the printing position P to increase the printing speed more than that in FIGS. 1 or 2 because the maximum rotary angle of daisy wheel 2 is 180° enough, but such method cannot be said to be the best because two ink rollers are required.

OBJECT OF THE INVENTION

A first object of the invention is to provide a printer which disposes the ink roller at a suitable position at an angle of 90° or less on the circumference of daisy wheel from the printing position and also controls the daisy wheel in the rotation direction thereof and its rotary angle corresponding to the position of type to be printed, so that the printing speed is improved.

A second object of the invention is to provide a printer which controls the rotation of daisy wheel to bring the type sufficiently into contact with the ink roller to thereby carry out the exact and distinct printing.

A third object of the invention is to provide a printer which has practically attained the above purpose by means of circuits simple in construction.

A fourth object of the invention is to provide a printer which prevents the daisy wheel from being deformed and is free from printing nonuniformity.

The above and further objects and features of the invention will more fully be apparent from the following detailed description with accompanying drawings.

DETAILED DESCRIPTION OF THE INVENTION

Figure 1:
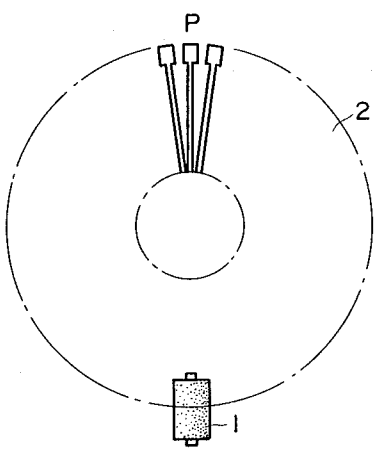
FIG. 1 PRIOR ART
FIGS. 1, 2 and 3 are views exemplary of the relation between the daisy wheel and the ink roller of conventional printer.
Figure 2:
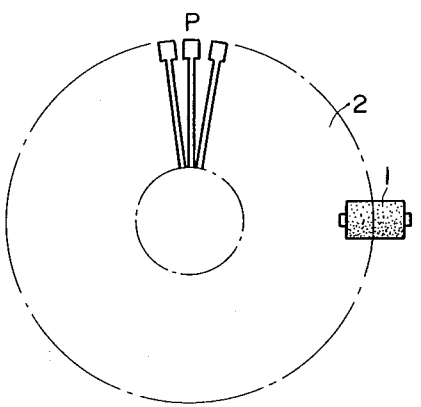
FIG. 2 PRIOR ART
Figure 3:
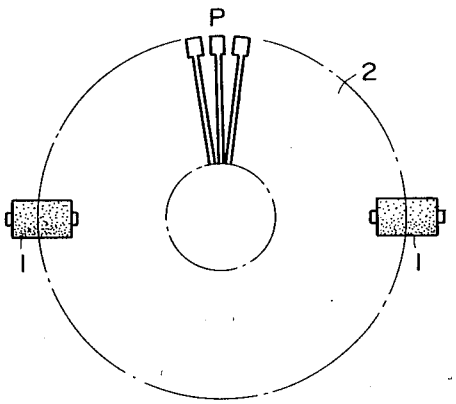
FIG. 3 PRIOR ART
Figures 4, 5, 6:
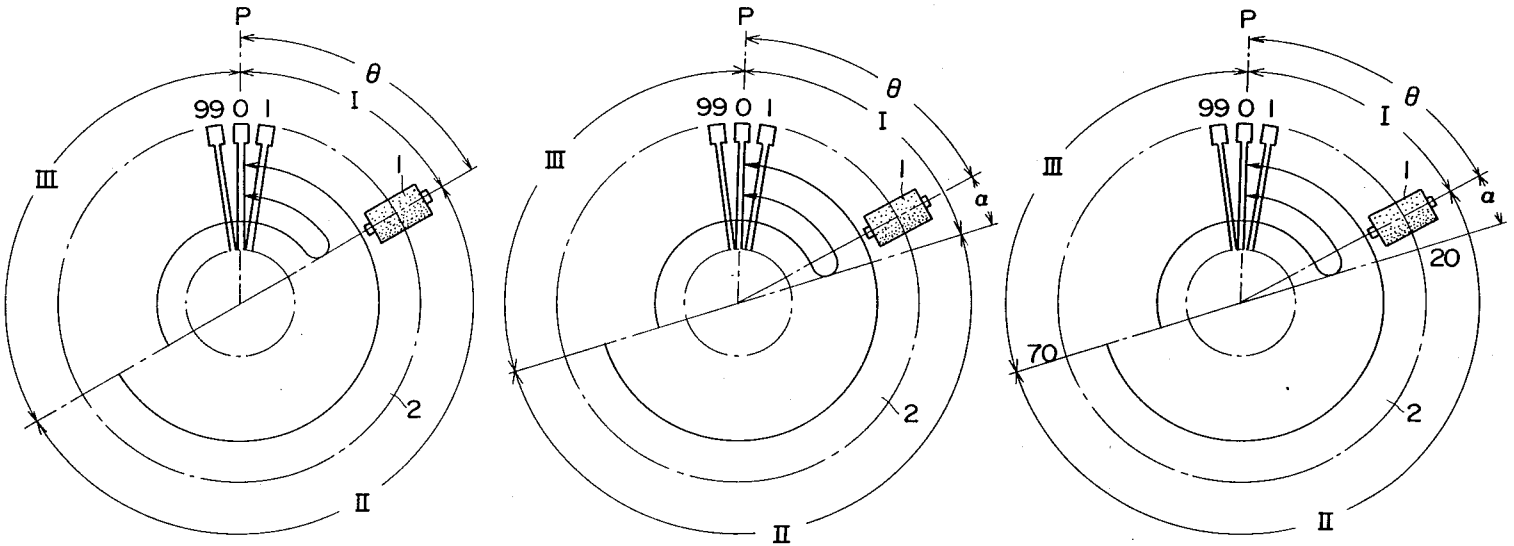
FIGS. 4, 5 and 6 are views exemplary of the relation between a daisy wheel and an ink roller at a printer of the invention.

The printer of the invention, as shown in FIG. 4, basically disposes an ink roller 1 at the position of a suitable angle $\theta$ at an angle of 90° or less on the circumference of a daisy wheel 2, for example, clockwise from the printing position P, the position of angle $\theta$ being formed in a first boundary position. A second boundary position is set at the position apart at an angle of 180° in circumference from the first boundary position. A semicircular portion not including printing position P is represented as a region II, a portion between the printing position P and the first boundary position, i.e., the ink roller set position, as a region I, and that between the printing position P and the second boundary position as a region III. At the time of command of printing, the type to be printed positioned in the region II is turned counterclockwise to the printing position P and passes through the ink roller 1 so as to be applied with ink, the type to be printed in the region I and III being turned clockwise once to the first boundary, i.e., the ink roller 1 set position, and applied with ink and then turned counterclockwise toward the printing position P.

In addition, in the drawings, reference numerals 0, 1 and 99 designate code number attached to each type, i.e., each type code. In a case where the daisy wheel 2 is in condition of printing standby to be discussed below and in the initial state, the type of code No. 0 is in the printing position P.

FIG. 5 shows a construction to apply ink by the ink roller 1 more reliably to the types, in which the ink roller 1 is set at the position of a suitable angle $\theta$ less than 90° circumferentially of daisy wheel 2 and, for example, clockwise from the printing position P. A first boundary position is set away by several fingers (at an angle $\alpha$ in FIG. 5) clockwise from the ink roller 1 set position, a second boundary position being set away by 180° circumferentially of daisy wheel 2 from the first boundary position. A semicircular portion not including the printing position P is represented by the region II, a region from the printing position P to the first boundary position, in other words, the position at an angle $\theta+\alpha$ circumferentially clockwise of daisy wheel 2, as a region I, and a portion from the printing position P counterclockwise toward the second boundary as a region III. The types positioned between the ink roller 1 set position and the printing position P in the region I and those in the region III, are once turned clockwise toward the first boundary position after passing through the ink roller 1 so as to be applied with ink, and then turned counterclockwise to the printing position P. The types positioned in the region II are turned counterclockwise toward the printing position P, on the way of which the types pass through the ink roller 1 and are applied with ink thereby. In this case, the types positioned between the ink roller 1 set position within the region I and the first boundary position, are turned once clockwise to the first boundary position and then counterclockwise toward the printing position P, thereby occurring a somewhat waste of time.

Referring to FIG. 6, the construction to save the above waste of time is shown, in which the ink roller 1 is disposed at the position at a moderate angle $\theta$ less than 90°, for example, clockwise circumferentially of the daisy wheel 2 from the printing position P, the position of angle $\theta$ being decided as the first boundary position. The second boundary position is defined at the position apart at an angle of 180° from the position apart by width of several fingers (the angle $\alpha$ in FIG. 5) circumferentially clockwise of daisy wheel 2 from the first boundary position. A portion not including the printing position P and of an angle of $180°+\alpha$ circumferential of daisy wheel 2 between the first and second boundary positions is represented by a region II. A portion between the printing position P and the first boundary position, i.e., the ink roller 1 set position, by a region I, and that between the printing position P and the second boundary position by a region III. Thus, the types positioned in the regions I and III are once turned clockwise and pass through the ink roller 1 set position and are turned further by an angle $\alpha$ so as to be applied with ink and thereafter turned counterclockwise toward the printing position P. The types in the region II are turned counterclockwise toward the printing position P, on the way of which it is applied with ink by the ink roller 1.

In an embodiment of the invention to be discussed below, the aforesaid first boundary position, that is, the ink roller 1 set position, as shown in FIG. 6, corresponds to the 17th among 100 fingers clockwise from the printing position P, the second boundary position to the 70th finger, an angle of 10.8° corresponding to three fingers is represented by $\alpha$, and an angle of 61.2° corresponding to seventeen fingers by $\theta$ between the printing position P and the ink roller 1 set position.

The printer of the invention provides fingers short in part at the daisy wheel 2 so that when the daisy wheel 2 is in the initial position and in the standby condition, the fingers short in part are in the ink roller 1 set position to be opposite to the ink roller 1, thereby preventing the daisy wheel 2 from being deformed caused by contact of type with the ink roller 1 for a long time.

Next, explanation will be given on an embodiment of the printer of the invention according to the drawings.

Figure 8:
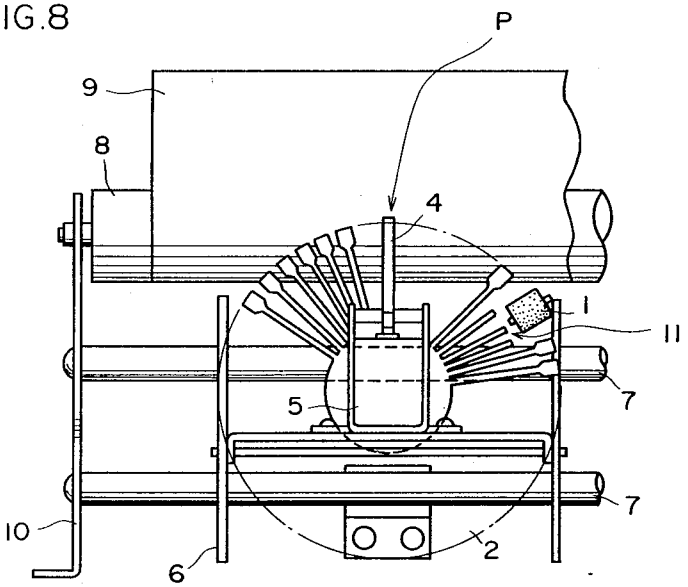
FIG. 8 is a schematic front view of the same.
Figure 7:
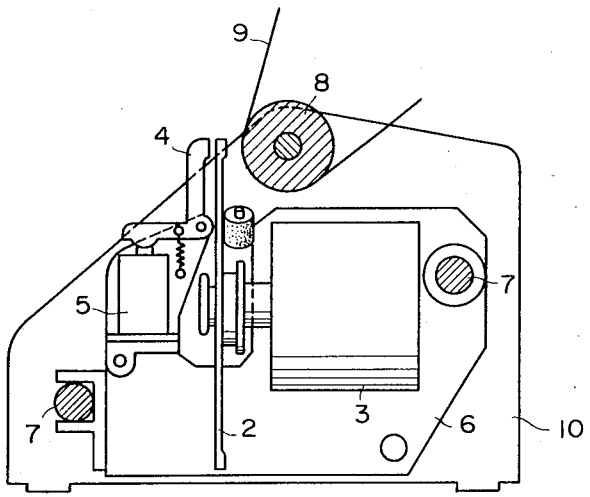
FIG. 7 is a schematic side view of the printer of the invention.

FIG. 7 is a schematic side view of the printer of the invention, and FIG. 8 is a schematic front view of the same, in which reference numeral 6 designates a carriage supported slidably through a moving mechanism (not shown) to guide shafts 7, 7 fixed to a frame 10. On the carriage 6 are disposed the daisy wheel 2 provided radially with fingers each having at the utmost end thereof a type, a pulse motor 3 for rotating the daisy wheel 2, a hammer 4 for striking the type at each finger, and a plunger 5. The frame 10 supports a platen 8 pivotally, on which a paper 9 is wound.

The ink roller 1, when the carriage 6 is moved, does not contact with the platen 8 and others and disposed at the position at an angle of 90° or less circumference of daisy wheel 2 from the printing position P. For the embodiment, at the position of 17th finger among the 100 fingers at the daisy wheel 2 and clockwise from the printing position P, i.e., at an angle of 61.2°, the ink roller 1 comes in contact with the types at the daisy wheel 2 following the rotation thereof, thereby applying ink to the types.

The daisy wheel 2 as abovementioned is provided with 100 fingers radially extending, the types formed at the utmost end of each finger being attached with the type code from No. 0 to 99 to be discussed below, so that the state where the type of type code 0 is in the printing position P is called the initial position of daisy wheel 2. In this embodiment, a part of 100 fingers at the daisy wheel 2 in the ink roller 1 set position, in other words, three fingers of a finger of code No. 17 and those at both sides thereof, when the daisy wheel 2 is in the initial position, are smaller in length to form a cutout 11, as shown in FIG. 8, so that when the daisy wheel 2 is kept in the initial position, the ink roller 1 does not contact with the type.

For carrying out printing, the paper 9 is wound onto the platen 8, and then the pulse motor 3 is driven to rotate the daisy wheel 2 and bring a desired type to the printing position P. At this time, since ink is applied on the type due to contact with the ink roller 1 following the rotation of daisy wheel 2, the plunger 5 is energized to drive the hammer 4, whereby a desired type is struck thereby to be printed on the paper 9. Then, the carriage moving mechanism (not shown) moves the carriage 6 to the next printing position, thereby being stand-by for the subsequent printing. If the next printing is not carried out within the predetermined time as described below, the daisy wheel 2 will restore to the initial position.

Figure 9:
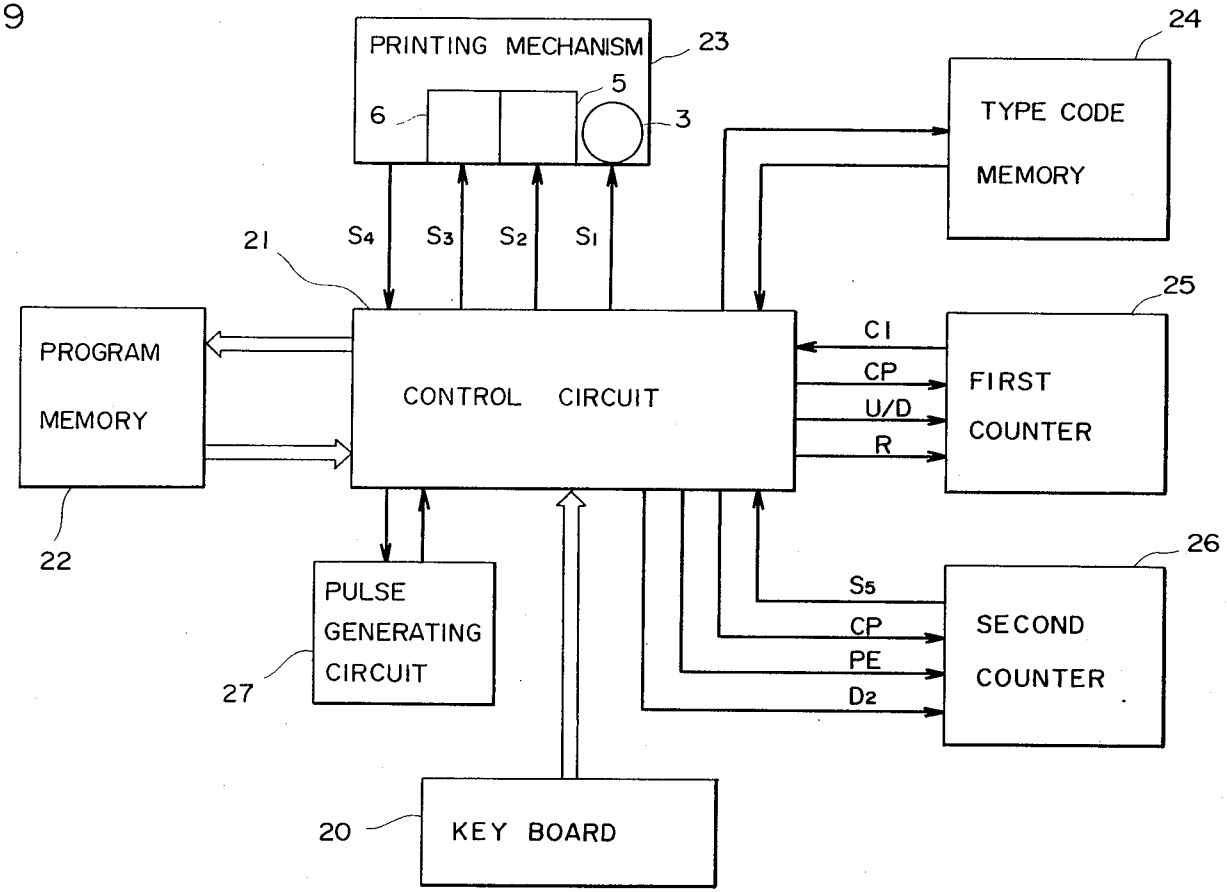
FIG. 9 is a block diagram of a control system for the printer.

FIG. 9 is a block diagram of a control system for the printer of the invention, in which reference numeral 20 designates a keyboard provided with numeric keys, alphabet keys, and various specific symbol keys or the like. When the keyboard 20 is operated to select the character to be printed, a key signal corresponding to the selected key and a printing signal for commanding the printing are given to a control circuit 21.

The control circuit 21 comprises a micro processor, and when given the key signal and printing signal from the keyboard 20, controls according to a program stored in a program memory 22 a printing mechanism 23 comprising the pulse motor 3, plunger 5, carriage 6, etc. The printing mechanism 23 is given a pulse signal $S_1$ for driving the pulse motor 3, a drive signal $S_2$ for the plunger 5, and a drive signal $S_3$ for the carriage 6, from the control circuit 21. The printing mechanism 23, when the daisy wheel 2 is put in the initial position, gives to the control circuit 21, as an initial position signal $S_4$, the origin pulse from the pulse motor 3 or a rotary encoder (not shown) connected to the daisy wheel 2.

In the drawing, reference numeral 24 designates a type code memory storing therein the code number corresponding to each type in order to specify each type at daisy wheel 2 corresponding to the key signal given from the keyboard 20. This embodiment disposes at the daisy wheel 2 100 fingers extending radially as shown in FIG. 8. In a case where the daisy wheel 2 is set in the initial position, three fingers opposite to the ink roller 1 are not provided with the types, but are cutout 11. Other 97 fingers provide the types at the utmost thereof respectively. The types are numbered by 0 to 99 (except for 16th, 17th and 18th ones) in code number, which are stored as, for example, No. 10 corresponding to letter "A", in the type code memory 24, the type code corresponding to the key signal given from the keyboard 20 operated is retrieved by the control circuit 21 and read therein.

A first counter 25 counts the amount of rotation of daisy wheel 2 from the initial position and comprises a centesimal up/down counter. In other words, the first counter 25 uses as the clock pulse CP the pulse to drive the pulse motor 3 for rotating the daisy wheel 2, and as the up/down signal U/D the signal to indicate the normal or reverse rotation of daisy wheel 2, thereby carrying out the up-count when the daisy wheel 2 rotates clockwise and the down-count when the same rotates counterclockwise. When the count advances to 99 at the up-counting, 0 is sequentially counted. When the down-count advances to 0, 99 is sequentially counted. Furthermore, in a case where the daisy wheel 2 restores to the initial position and the initial position signal $S_4$ is given from the printing mechanism 23 to the control circuit 21, the first counter 25 is given a reset signal R from the control circuit 21 to be reset. A counting value C1 of the first counter 25, as discussed below, is read as the data for rotation control of daisy wheel 2 into the control circuit 21 at each time the printing signal is given thereto.

A second counter 26 comprises a down counter which is so constructed that data D2 sent from the control circuit 21 is preset at the time when the second counter 26 is given a preset enable signal PE from the control circuit 21, so that the pulse to drive the pulse motor 3 is counted down as the clock pulse CP from the value of preset data D2. At the time when the down-count value C2 becomes zero, the second counter 26 gives a signal $S_5$ to the control circuit 21, thereby stopping a pulse input given to the pulse motor 3 for driving thereof.

A pulse generating circuit 27 generates pulse for driving the pulse motor 3, the generated pulse signal is converted by the control circuit 21 into the signal corresponding to the rotation direction of daisy wheel 2 and given properly to the pulse motor 3 to rotationally drive it and also given as the clock pulse CP to the first and second counters 25 and 26.

Figure 10:
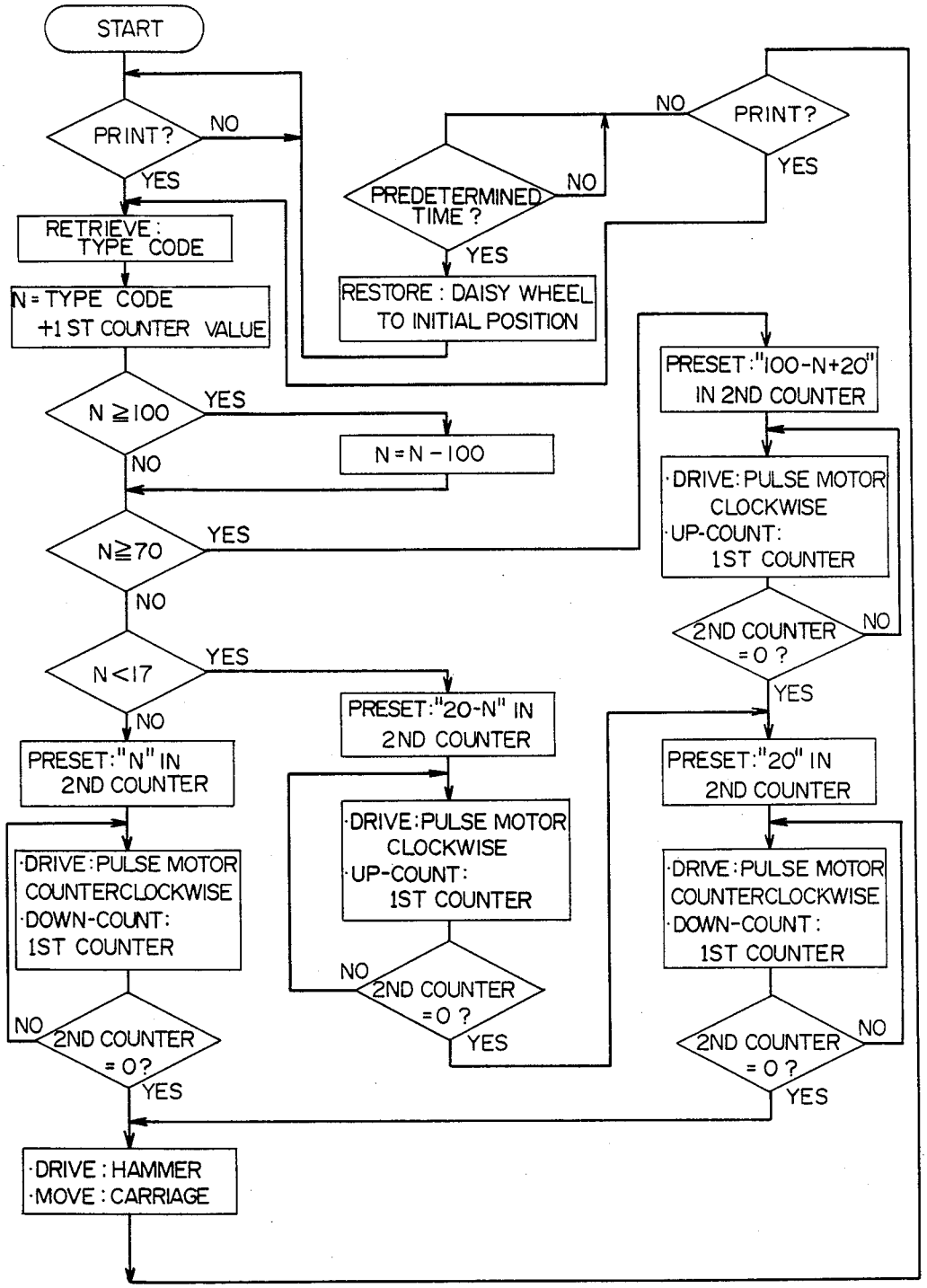
FIG. 10 is a flow chart of process contents for a control circuit of the printer.
Figure 11:
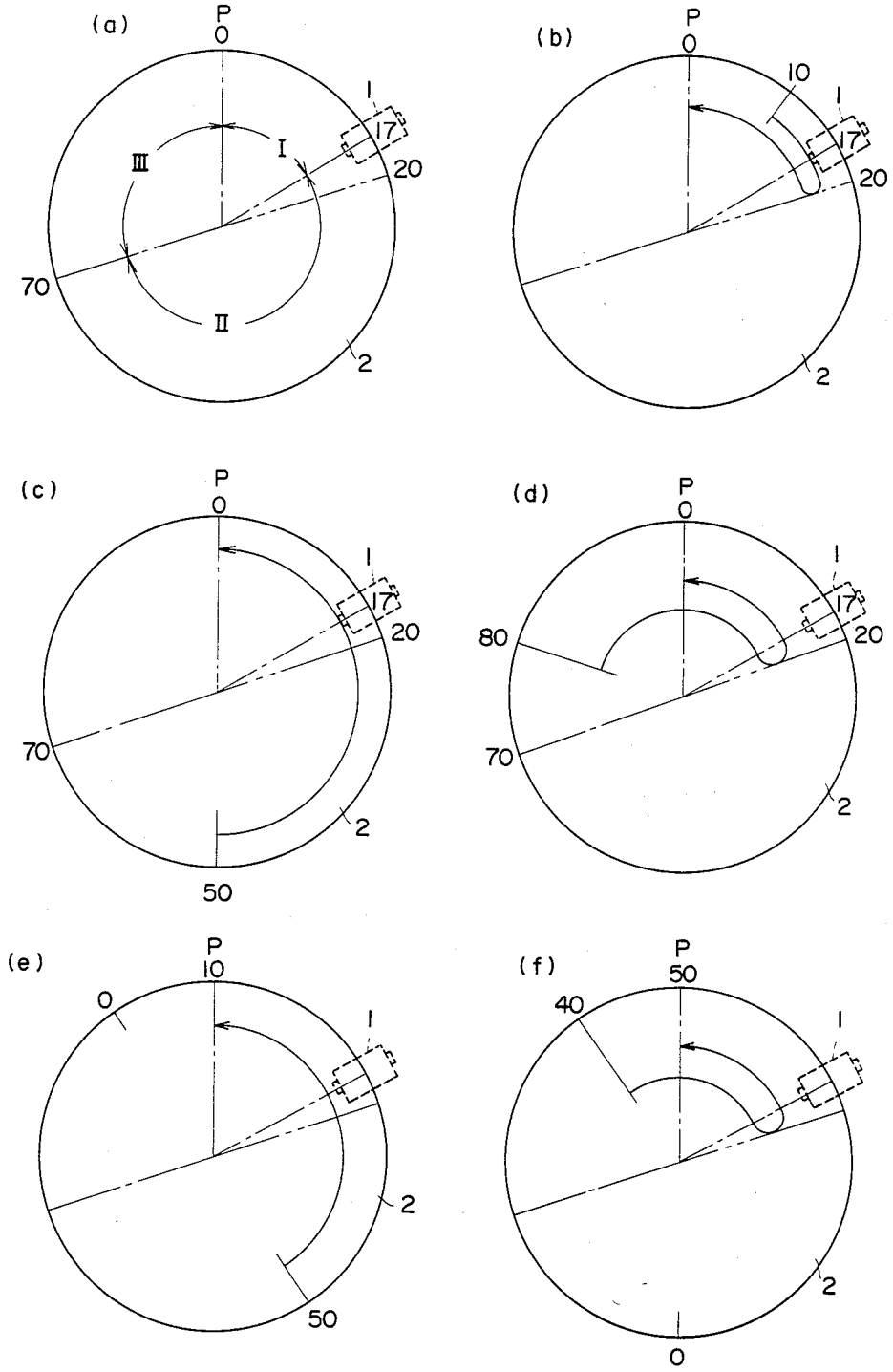
FIG. 11 is a view exemplary of the rotation direction of the daisy wheel.

Next, explanation will be given on operation of the above constructed printer of the invention in accordance with the FIG. 10 flow chart and the FIG. 11 illustration showing the rotation direction of daisy wheel 2.

In this embodiment, as abovementioned, the state where the type of code number of 0 is in the printing position P as shown in FIG. 11-(*a*), is called the initial position of daisy wheel 2, the ink roller 1 is disposed at the position of the 17th finger clockwise from the printing position P, the first boundary position for defining the rotation direction of daisy wheel 2 is the ink roller 1 set position, and the position of the 70th finger apart from the ink roller 1 set position by an angle of $180°+\alpha$($\alpha$: an angle corresponding to widths of three fingers) is the second boundary position. One of two portions divided by the first and second boundary positions and not including the printing position P is represented by the region II, a portion between the printing position P and the first boundary position, i.e., the ink roller 1 set position, is represented by that I, and a portion between the printing position P and the second boundary position is represented by that III. The types positioned within the regions I and III are once turned clockwise to the position of an angle of $\theta+\alpha°$ from the printing position P, i.e., the position of the 20th finger, and thereafter turned counterclockwise to position at the printing position P respectively.

Firstly, explanation will be given on operation of carrying out printing in the state where the daisy wheel 2 is stationary at its initial position. In a case where the letters of code number up to No. 15 (Nos. 16 and 17 are cut out), in other words, the types positioned in the region I, are printed, the control circuit 21, when given the print signal and key signals from the keyboard 20, reads from the type code memory 24 the corresponding type code on the basis of key signal given from the keyboard 20 and also reads the count value C1 of first counter 25, thereby performing computation of "N=Type code+First counter value C1", where since the daisy wheel 2 is in the initial position, the count value C1 of first counter 25 is zero and the computation result "N" is equal to the value of type code. Hence, for example, when the type of code number 10 is selected, the computation result is "N=10". Continuously, the control circuit 21 decides whether or not the computation result "N" is larger than "100", because "N" more than "100" means one rotation of daisy wheel 2 and numerals in the 100 order are meaningless in the actual computation. Now, in this case, since "N" is "10" and smaller than "100", in order to decide whether or not the type selected is positioned at present within the region III, it is decided whether or not "N" is larger than "70". Now, since "N" is "10" and smaller than "70", in order to decide whether or not the type selected positioned at present in the region I, it is decided whether or not "N" is smaller than "17". Since the computation result "N" is "10" and smaller than "17", in order to obtain data D2 necessary to rotate the selected type from the printing position P clockwise toward the position of 20th finger, "20−N" is computed. Since the preset enable signal PE is given to the second counter 26, the computation result "10" is preset as the data D2 to the second counter 26. Sequentially, the control circuit 21 generates a signal for rotating clockwise the pulse motor 3 at the printing mechanism 23, thereby driving the pulse motor 3 by the pulse and rotating the daisy wheel 2 clockwise (see FIG. 11-(*b*)). The pulse for driving the pulse motor 3 is given as the clock pulse CP to the second counter 26, the second counter 26 counting down one by one per one shot of pulse, so that when 10 pulses are given, the count value C2 becomes "0", whereby the signal $S_5$ is given to the control circuit 21. Hence, the pulse input to the pulse motor 3 is stopped to stop the rotation of daisy wheel 2.

The clockwise rotation of daisy wheel 2 makes the type of code No. 10 rotate clockwise to the position of 20th finger from the printing position P, on the way of which the ink roller 1 applies ink on the type of code No. 10. Simultaneously with the above, the first counter 25 is given the pulse as the clock pulse CP to rotate the pulse motor 3 clockwise, and counts up the count value C1 only by "10". Continuously, the control circuit 21 gives the preset enable signal PE to the second counter 26, data "20" for rotating the type at the position of 20th finger clockwise from the printing position P toward the printing position P is preset in the second counter 26 so that the pulse is given to rotate the pulse motor 3 counterclockwise, and the daisy wheel 2 is rotated counterclockwise until the second counter 26 counts down to "0". At the time of down-count of second counter 26 down to "0", the generation of pulse signal from the control circuit 21 stops to stop the rotation of daisy wheel 2, whereby the type of code No. 10 to be printed is positioned at the printing position P. Then, the control circuit 21 gives a plunger driving signal $S_2$ to the printing mechanism 23 to thereby energize the plunger 5, by which the hammer 4 is driven to strike against the platen 8 the type of code No. 10 positioned at the printing position P. At this time, the first counter 25 counts down by "20" its count value C1 due to the pulse for rotating the pulse motor 3 counterclockwise, so that the count value C1 exceeds "0" to be "90", which shows that the type of code No. 0 transfers clockwise from the printing position P to the position of 90th finger.

Next, explanation will be given on a case where the type of code No. 50 positioned in the region II is printed when the daisy wheel 2 is in the initial position. In this case, as the same as the former case, in order that the computation result "N" becomes "50" after the step of deciding the region, the type of code No. 50 is discriminated to be in the region II, "50" as data D2 necessary to rotate the above type to the printing position P is preset in the second counter 26, and sequentially the pulse to rotate the pulse motor 3 counterclockwise is generated, so that the daisy wheel 2 is rotated counterclockwise until the down count value of second counter 26 becomes "0". At the time of having generated 50 pulses, the count value C2 of second counter 26 is "0", resulting in that the type of code No. 50 is in the printing position P (see FIG. 11-(*c*)), at which time the type of code No. 50 comes into contact with the ink roller 1 on the way of rotation toward the printing position P, thereby being applied with ink. Accordingly, at this time, if the hammer 4 is driven, the type of code No. 50 is printed. At this time, the count value C1 of first counter 25 is counted down from "0" and exceeds "99" to be "50".

Next, explanation will be given on the case where the types of code Nos. 70 to 99 and in the region III, are printed when the daisy wheel 2 is in the initial position. For example, the type of code No. 80 is assumed to be selected by the keyboard 20. After the step of deciding the region in which the type actually exists as the same as the former case, the computation result "N" is "80" more than "70", thereby deciding the type existence in the region III. Next, in order to obtain data D2 necessary to rotate the selected type from the printing position P to the position of 20th finger, "100−N+20" is computed and the computation result "40" is preset as the data D2 in the second counter 26. Continuously, the control circuit 21 generates pulse for rotating the pulse motor 3 clockwise to thereby rotate the daisy wheel 2 clockwise until the count value C2 of second counter 26 is counted down to "0". In this case, the second counter 26 has preset "40" so that at the time of generating 40 pulses, in other words, after the type of code No. 80 contacts with the ink roller 1, and further at the time of having rotated to an extent of three fingers clockwise to the position of 20th finger from the printing position, the pulse generation is stopped to once stop the rotation of daisy wheel 2. Continously, the control circuit 21 presets data "20" in the second counter 26 and generates pulse to rotate the pulse motor 3 counterclockwise, thus rotating the daisy wheel 2 counterclockwise. When the pulse motor 3 is given 20 pulses so that the count vaue C2 of second counter 26 becomes "0", the generation of pulse stops and the daisy wheel 2 stops its rotation to thereby put the type of code No. 80 in the printing position P. Hence, at this time, the hammer 4, when driven, makes the type of code No. 80 print (see FIG. 11-(*d*)), at which time the first counter 25 counts up only by "40" due to the clockwise rotation of pulse motor 3, and thereafter counts down due to the counterclockwise rotation of the same, the count value C1 being "20".

Next, explanation will be given on the printing operation in continuation, for example, the operation of printing the type of code No. 50 in continuation after the type of code No. 10 is printed when the daisy wheel 2 is put in the initial position. In this case, after the type of code No. 10 is printed as above-mentioned, when the key signal corresponding to the type of code No. 50 is given to the control circuit 21 from the keyboard 20, the control circuit 21 reads the corresponding type code "50" from the type code memory 24 and fetches the count value C1: "90" from the first counter 25, thereby adding both the data. Then, the control circuit 21 enters the decision step of computation result "N", in which the computation result "140" is larger than "100", whereby the control circuit 21 enters the computation step of "140−100" and sequentially enters the decision step of subtraction result "40". Now, since "40" is larger than "17", the type of code No. 50 is decided to be at present in the region II and the data "40" is preset in the second counter 26, and thereafter the pulse for counterclockwise rotating the pulse motor 3 is generated to rotate the daisy wheel 2 counterclockwise. The daisy wheel 2 continues its rotation by 40 pulses until the second counter 26 counts down to "0" (see FIG. 11-(*e*)). Hence, when the count value C2 of second counter 26 is "0", the type of code No. 50 is put in the printing position P and printed by the driving of the hammer 4, at which time the count value C1 of first counter 25 is counted down to "50" because of countdown by "40" from "90".

In a case where, for example, the type of code No. 40 is printed in continuation, since the computation result "N" is "90" as the same as the abovementioned, it is decided that the type of code No. 40 exists in the region III. Hence, "100−90+20" is computated, the pulse motor 3 is rotated clockwise only by "30", ink is applied onto the type, and the pulse motor 3 is rotated counterclockwise by 20 pulses, so that the type of code No. 40 is put in the printing position P to be printed (see FIG. 11-(*f*)). Thus, even when the key input is given in continuation, the computation process is carried out on the basis of numeral values of type code and the count value C1 of first counter 25 so that the rotation direction and rotary angle of daisy wheel 2 are controlled on the basis of computation result, thereby enabling the continuous printing in a short time.

In addition, if the key input is not given in continuation for more than the predetermined time period, the control circuit 21 decides the count value C1 of first counter 25. If it is "1" to "50", the daisy wheel 2 is rotated counterclockwise, and if "51" to "99", clockwise, so that the daisy wheel 2 is restored to the initial position. When the initial position signal $S_4$ is generated by the restoration of daisy wheel 2, the control circuit 21 resets the first counter 25. Therefore, the cutout 11 of 3 fingers at the daisy wheel 2 is put at the ink roller 1 set position to thereby avoid contact in vain of the types with the daisy wheel 2, thus preventing the daisy wheel 2 from being deformed.

As seen from the above, the printer of the invention controls the daisy wheel in the rotation direction by a distance between the ink roller and the type to be printed, in other words, the circumferential angle of daisy wheel, thereby improving the printing speed. Also, in a case where the type once passes through the printing position and then rotates reversely to the ink roller set position, this printer is so constructed that the type passes through the ink roller set position in width of several fingers and thereafter is rotated in the reverse direction to be put in the printing position, thereby enabling exact application of ink for the types to expect an improvement in printing quality.

Furthermore, the printer of the invention, in the stand-by condition of daisy wheel, puts the cutout of finger thereof in the ink roller set position, whereby there is no fear of deformation of daisy wheel, and the prevention of ununiformity in print is possible.

Alternatively, the ink roller in this embodiment may be provided within an angle of 90° counterclockwise from the printing position. With the ink roller positioned in this manner, the system will operate in the same manner as the previously described systems (having the ink roller positioned 90° clockwise from the printing position) if the daisy wheel were made to rotate in the opposite direction.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A serial printer, comprising:

a daisy wheel having a plurality of radially extending fingers, each of at least some of the fingers having equal lengths and each including a type mounted to an end thereof which types define the general circumferential periphery of the wheel, the serial printer defining a printing position which is circumferentially located on the wheel, the wheel being bi-directionally rotatable to position a selected type in the printing position on the circumference of the wheel;

an ink roller disposed in a position circumferentially offset from the printing position by less than 90°, the ink roller being adapted to apply ink to the types of the wheel as the types are rotated therepast; and means for controlling the rotation of the daisy wheel, the wheel control means causing the wheel to rotate in a first rotational direction and in a second rotational direction, the first rotational direction being defined as the direction in which the shortest circumferential distance is traversed when the daisy wheel is rotated from the printing position to the position of the ink roller, the second rotational direction being defined as the direction which is opposite the first rotational direction, the circumference of the daisy wheel being divided into first, second and third definable regions, the first region extending in the first rotational direction between the printing position and a first boundary position, the first boundary position being defined as a position on the circumference of the daisy wheel and situated N number of fingers in the first rotational direction from the ink roller position, the second region extending in the first rotational direction between the first boundary position and a second boundary position, the second boundary position being defined as a position on the circumference of the daisy wheel which is at least 180° in the first rotational direction from the first boundary position, the third region extending in the first rotational direction between the second boundary position and the printing position, wherein a type situated in the first region is moved in the first rotational direction to the first boundary position and subsequently moved in the second rotational direction to the printing position, a type situated in the second region is moved in the second rotational direction to the printing position, and a type situated in the third region is moved in the first rotational direction to the first boundary position and subsequently moved in the second rotational direction to the printing position.

2. A printer as set forth in claim 1, wherein said N-number of fingers is zero.

3. A printer as set forth in claim 1, wherein said N-number of fingers is greater than 1.

4. A printer as set forth in claim 1, wherein said second boundary position is 180° from said first boundary position.

5. A printer as set forth in claim 1, wherein said second boundary position is situated 180° and at least one finger in the first rotational direction from said first boundary position.

6. A printer as set forth in claim 1, wherein at least one of the fingers is shorter in length than the other fingers so as to not contact the ink roller.

7. A printer as set forth in claim 2, wherein at least one of the fingers is shorter in length than the other fingers so as to not contact the ink roller.

8. A printer as set forth in claim 3, wherein at least one of the fingers is shorter in length than the other fingers so as to not contact the ink roller.

9. A printer as set forth in claim 4, wherein at least one of the fingers is shorter in length than the other fingers so as to not contact the ink roller.

10. A printer as set forth in claim 5, wherein at least one of the fingers is shorter in length than the other fingers so as to not contact the ink roller.

11. A printer as defined by claim 1, wherein the daisy wheel control means includes:

first counter means for counting the amount of rotation of the daisy wheel, the first counter means providing a count data word representative of the rotational position of the daisy wheel;

means for generating a code word representative of a type that is selected to be printed;

means for summing the count data word and the code word;

means responsive to the sum of the count data word and the code word for determining the position of the type selected to be printed with respect to the first, second and third regions, the type position determining means providing a signal representative of the position of the type selected to be printed;

means responsive to the signal of the type position determining means for selecting one of the first and second rotational directions of the daisy wheel and for determining the amount of rotation of the daisy wheel necessary to position the type selected to be printed at one of the first boundary position and the printing position; and second counter means for counting the amount of rotation of the daisy wheel necessary to position the type selected to be printed at one of the first boundary position and the printing position.

12. A printer as set forth in claim 11, wherein at least one of the fingers is shorter in length than the other fingers so as to not contact the ink roller.

13. A printer as defined by claim 2, wherein the daisy wheel control means includes:

first counter means for counting the amount of rotation of the daisy wheel, the first counter means providing a count data word representative of the rotational position of the daisy wheel;

means for generating a code word representative of a type that is selected to be printed;

means for summing the count data word and the code word;

means responsive to the sum of the count data word and the code word for determining the position of the type selected to be printed with respect to the first, second and third regions, the type position determining means providing a signal representative of the position of the type selected to be printed;

means responsive to the signal of the type position determining means for selecting one of the first and second rotational directions of the daisy wheel and for determining the amount of rotation of the daisy wheel necessary to position the type selected to be printed at one of the first boundary position and the printing position; and second counter means for counting the amount of rotation of the daisy wheel necessary to position the type selected to be printed at one of the first boundary position and the printing position.

14. A printer as set forth in claim 13, wherein at least one of the fingers is shorter in length than the other fingers so as to not contact the ink roller.

15. A printer as defined by claim 3, wherein the daisy wheel control means includes:

first counter means for counting the amount of rotation of the daisy wheel, the first counter means providing a count data word representative of the rotational position of the daisy wheel;

means for generating a code word representative of a type that is selected to be printed;

means for summing the count data word and the code word;

means responsive to the sum of the count data word and the code word for determining the position of the type selected to be printed with respect to the first, second and third regions, the type position determining means providing a signal representative of the position of the type selected to be printed;

means responsive to the signal of the type position determining means for selecting one of the first and second rotational directions of the daisy wheel and for determining the amount of rotation of the daisy wheel necessary to position the type selected to be printed at one of the first boundary position and the printing position; and second counter means for counting the amount of rotation of the daisy wheel necessary to position the type selected to be printed at one of the first boundary position and the printing position.

16. A printer as set forth in claim 15, wherein at least one of the fingers is shorter in length than the other fingers so as to not contact the ink roller.

17. A printer as defined by claim 4, wherein the daisy wheel control means includes:

first counter means for counting the amount of rotation of the daisy wheel, the first counter means providing a count data word representative of the rotational position of the daisy wheel;

means for generating a code word representative of a type that is selected to be printed;

means for summing the count data word and the code word;

means responsive to the sum of the count data word and the code word for determining the position of the type selected to be printed with respect to the first, second and third regions, the type position determining means providing a signal representative of the position of the type selected to be printed;

means responsive to the signal of the type position determining means for selecting one of the first and second rotational directions of the daisy wheel for determining the amount of rotation of the daisy wheel necessary to position the type selected to be printed at one of the first boundary position and the printing position; and second counter means for counting the amount of rotation of the daisy wheel necessary to position the type selected to be printed at one of the first boundary position and the printing position.

18. A printer as set forth in claim 17, wherein at least one of the fingers is shorter in length than the other fingers so as to not contact the ink roller.

19. A printer as defined by claim 5, wherein the daisy wheel control means includes:

first counter means for counting the amount of rotation of the daisy wheel, the first counter means providing a count data word representative of the rotational position of the daisy wheel;

means for generating a code word representative of a type that is selected to be printed;

means for summing the count data word and the code word;

means responsive to the sum of the count data word and the code word for determining the position of the type selected to be printed with respect to the first, second and third regions, the type position determining means providing a signal representative of the position of the type selected to be printed;

means responsive to the signal of the type position determining means for selecting one of the first and second rotational directions of the daisy wheel for determining the amoung of rotation of the daisy wheel necessary to position the type selected to be printed at one of the first boundary position and the printing position; and second counter means for counting the amount of rotation of the daisy wheel necessary to position the type selected to be printed at one of the first boundary position and the printing position.

20. A printer as set forth in claim 19, wherein at least one of the fingers is shorter in length than the other fingers so as to not contact the ink roller.

* * * * *